US006186044B1

(12) United States Patent
Hajek, Jr. et al.

(10) Patent No.: US 6,186,044 B1
(45) Date of Patent: Feb. 13, 2001

(54) FLUID CONTROL SYSTEM WITH FLOAT CAPABILITY

(75) Inventors: Thomas J. Hajek, Jr., Lockport; Srikrishnan T. Tolappa, Aurora, both of IL (US)

(73) Assignee: Caterpillar Inc., Peoria, IL (US)

( * ) Notice: Under 35 U.S.C. 154(b), the term of this patent shall be extended for 0 days.

(21) Appl. No.: 09/264,827

(22) Filed: Mar. 8, 1999

(51) Int. Cl.[7] ..... F15B 11/024
(52) U.S. Cl. ..... 91/437; 91/447
(58) Field of Search ..... 91/33, 436, 437, 91/438, 447

(56) References Cited

U.S. PATENT DOCUMENTS 3,381,587 * 5/1968 Parquet ..... 91/447
3,965,587 * 6/1976 Johns ..... 91/436
4,093,002 * 6/1978 Tardy ..... 91/447
4,204,459 * 5/1980 Johnson ..... 91/447
4,958,553 * 9/1990 Ueno ..... 91/447
5,331,882 7/1994 Miller ..... 91/461

* cited by examiner

*Primary Examiner*—F. Daniel Lopez
(74) *Attorney, Agent, or Firm*—Haverstock, Garrett & Roberts; J. W. Burrows

(57) ABSTRACT

A fluid control system provides a float capability for a double-acting actuator. The system includes pilot operated check valves disposed between the double-acting actuator and first and second ports of a pilot operated directional control valve. The directional control valve and the check valves are cooperatively operable under first and second pilot signal conditions to extend and retract the double-acting actuator. The system includes a valve arrangement connected to the check valves and the directional control valve for producing the first and second pilot signal conditions thereon, including also directing the first pilot signal condition to the second pilot signal condition when the first pilot signal condition reaches a predetermined signal strength, to initiate a float capability.

4 Claims, 1 Drawing Sheet

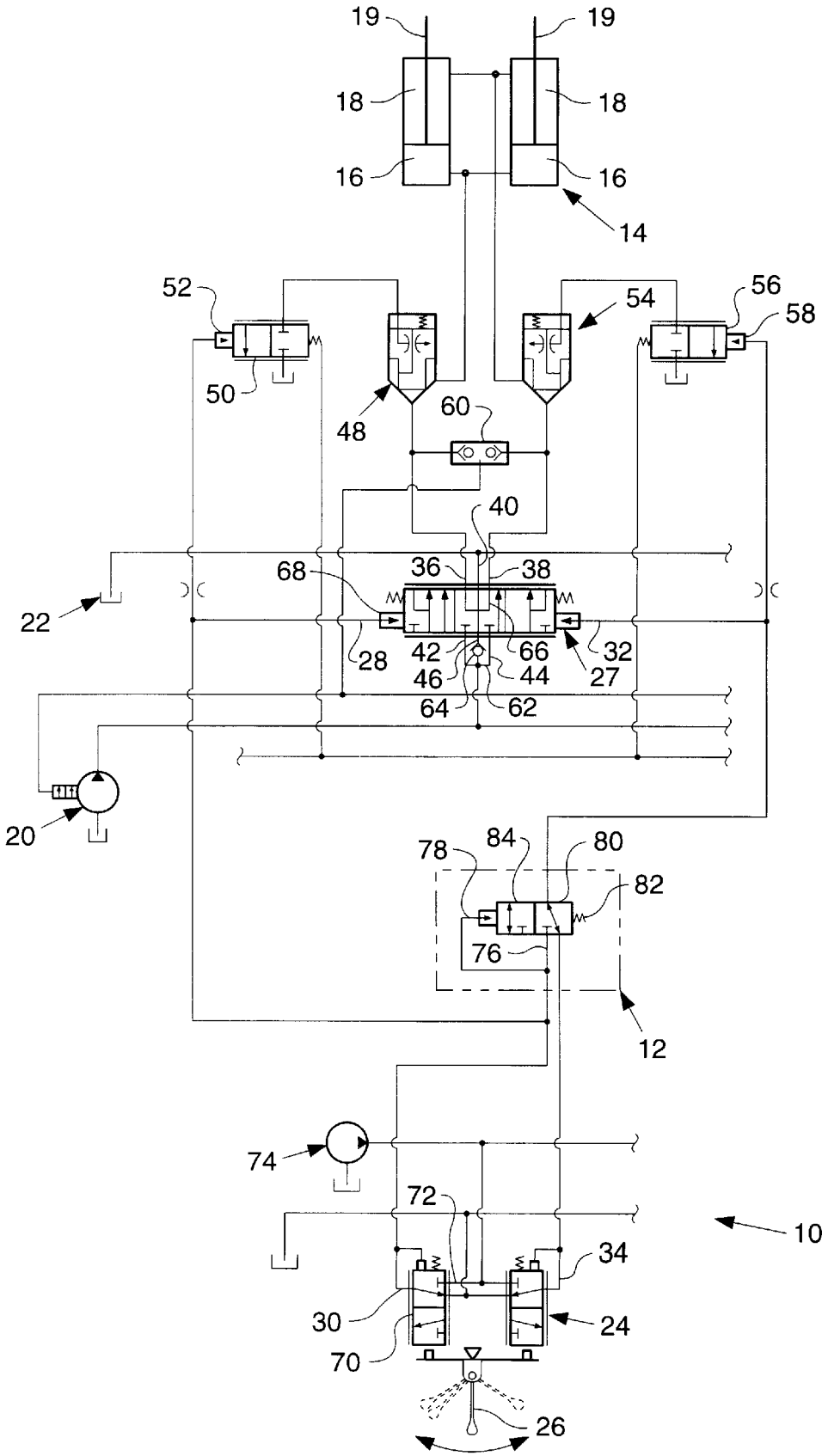
19
19
18
18
16
16
14
52
54
56
58
50
48
60
40
68
36
38
22
28
42
66
32
46
44
27
64
62
20
78
84
80
82
76
12
74
72
10
34
30
24
70
26

FLUID CONTROL SYSTEM WITH FLOAT CAPABILITY

TECHNICAL FIELD

This invention relates generally to a fluid control system for a lift actuator for a bucket of a loader or the like, and more particularly, to a fluid control system having a valve arrangement providing a simple, easy to use float capability.

BACKGROUND ART

Fluid control systems including a float capability, that is, the ability for fluid to move between one actuating chamber of a double acting actuator such as a lift actuator or the like and another actuating chamber thereof under equalized pressure conditions to provide a ground following capability, are well known. Typically however, the known systems utilize a spool type directional control valve for the actuator having added float position, which adds complexity, cost and leakage potential. It has also been problematic to provide a float capability in systems having check valves between the actuator and the directional control valve, as the checks can interfere with the free flow of fluid to and from the actuating chambers.

Accordingly, the present invention is directed to overcoming one or more of the problems as set forth above.

DISCLOSURE OF THE INVENTION

In one aspect of the present invention, a fluid control system providing a simple, easy to use float capability for a double-acting actuator having a first actuating chamber, a second actuating chamber, and an actuating member such as a piston rod disposed for movement therebetween, is disclosed. The system includes a first pilot signal operated check valve connected to the first actuating chamber and operable for controlling fluid flow thereto and therefrom, a second pilot signal operated check valve connected to the second actuating chamber and operable for controlling fluid flow thereto and therefrom, and a pilot signal operated directional control valve. The directional control valve has a first port connected to the first pilot signal operated check valve, a second port connected to the second pilot signal operated check valve, a tank port and a pump port. The directional control valve and the check valves are cooperatively operable under a first pilot signal condition to allow fluid flow from the first actuating chamber to the tank port, and fluid flow from the pump port to the second actuating chamber, and the directional control valve and the check valves are cooperatively operable under a second pilot signal condition to allow fluid flow between the actuating chambers to allow pressure conditions therein to equalize such that the actuating member can float. The system importantly further includes a valve arrangement connected to the check valves and the directional control valve for producing the first and second pilot signal conditions thereon, including changing the first pilot signal condition to the second pilot signal condition when the first pilot signal condition reaches a predetermined signal strength, to initiate the float capability.

BRIEF DESCRIPTION OF THE DRAWING

The sole drawing is a schematic illustration of an embodiment of the present invention.

BEST MODE FOR CARRYING OUT THE INVENTION

A fluid control system 10 including a pilot control valve 12 providing a float capability constructed and operable according to the teachings of the present Invention is shown. System 10 includes a double acting hydraulic actuator 14 having a pair of first actuating chambers 16, a pair of second actuating chambers 18, and a pair of piston rods 19 movable therebetween. Actuator 14 is representative of a wide variety of hydraulic cylinders used for such purposes as, but not limited to, raising and lowering or tilting a bucket of a loader, or a blade of a grader, bulldozer or other work machine (not shown). System 10 includes a hydraulic pump 20, a tank 22, and an operator controlled pilot actuator valve 24 having a control lever 26.

System 10 includes a directional control valve 27 which is an infinitely variable, pilot signal controlled six way, three position valve having a first pilot signal port 28 connected to a first pilot actuator port 30 of pilot actuator valve 24, and a second pilot signal port 32 connected to a second pilot actuator port 34 of valve 24 via pilot control valve 12. Control valve 27 includes a first actuating chamber port 36, a second actuating chamber port 38, a tank port 40, a first pump port 42, a second pump port 44, and a cross over port 46. First actuating chamber port 36 is connected to first actuating chambers 16 via a first poppet valve 48 controlled by a first pilot stage control 50 having a pilot signal port 52 connected to first pilot actuator port 30 of pilot actuator valve 24. Second actuating chamber port 38 is connected to second actuating chambers 18 of actuator 14 through a second poppet valve 54 controlled by a second pilot stage control 56 having a pilot signal port 58 connected to second pilot actuator port 34 of pilot actuator valve 24. Pilot stage controls 50 and 56 are operable in the conventional manner under control of pilot signals received from pilot actuator valve 24 for controlling respective poppet valves 48 and 54 for controlling fluid flow from the respective actuating chambers 16 and 18. A fluid resolver 60 is connected between poppet valves 48 and 54 for resolving a load control signal generated thereby to be communicated to other locations, such as to pump 20, as is well known in the art. First pump port 42 and second pump port 44 are connected to pump 20 via a connecting passage 62 which also connects to cross over port 46 via a check valve 64 operable to allow flow from cross over port 46 to connecting passage 62, but not from connecting passage 62 to cross over port 46.

Control valve 27 is positionable in a middle neutral position 66 as shown when pilot signals on pilot signal ports 28 and 32 are generally equal such that first and second actuating chamber ports 36 and 38 are connected together. Control valve 27 is movable to a second position 68 to the left of neutral position 66 by communication of a pilot signal from first pilot actuator port 30 of pilot actuator valve 24 to signal port 28, such that fluid flow from pump 20 is allowed through pump port 44 and second actuating chamber port 38 to second poppet valve 54. The fluid can then flow through poppet valve 54 to second actuating chambers 18 of actuator 14. At the same time, the pilot signal is present on signal port 52 of control 50 to allow poppet valve 48 to open and allow flow from first actuating chambers 16 to first actuating chamber port 36 and through control valve 27 to tank port 40. Using the valve arrangement shown, this would be accomplished by moving lever 26 of actuator valve 24 to a left position. Here, actuator valve 24 is a double spool valve having a left spool 70 which is moved towards its bottom position for producing the above discussed pilot signal on signal ports 28 and 52 when lever 26 is moved to a left position.

Left spool 70 receives pressurized fluid through a port 72 connected to a supply pump 74 and is operable when moved to its bottom position by lever 26 to direct the pressurized fluid through actuator port 30 to the signal ports 28 and 52 for moving valve 27 to the second position. At the same time, the pilot signal is present on a port 76 and a pilot signal port 78 of pilot control valve 12. Control valve 12 is normally maintained in a right position 80 as shown by a large spring 82 positioned for opposing pilot signals received through pilot signal port 78. In position 80, second pilot actuator port 34 of actuator valve 24 is communicated with pilot signal port 32 of directional control valve 27 and signal port 58 of control 56. Importantly however, control valve 12 is moved to a left position 84 when a pilot signal on signal port 78 is of a predetermined strength sufficient for overcoming spring 82. This is accomplished by moving lever 26 further to the left so as to increase the pressurized flow through left spool 70 from supply pump 74 to signal port 78. When control valve 12 is in left position 84 the pilot signal flow through left spool 70 will pass through control valve 12 to pilot signal port 32 of directional control valve 27 and signal port 58 of control 56 such that directional control valve 27 will be urged to its neutral position and poppet valve 54 will be allowed to open. Because actuating chamber ports 36 and 38 of directional control valve 27 are connected together when valve 27 is in neutral position 66 and both poppet valves 48 and 54 are allowed to open, pressure conditions in actuating chambers 16 and 18 will be equalized, and piston rod 19 will be allowed to float so as to be able to follow surface contours and the like. Then, when it is desired to deactivate the float capability, lever 26 is simply moved to another position to decrease the strength of the signal on signal port 78 to allow control valve 12 to again move to right position 80.

INDUSTRIAL APPLICABILITY

The present invention has utility for a wide variety of fluid system applications wherein a simple, easy to use float capability is desired. For instance, as noted above this can include the bucket of a loader, or the blade of a grader, bulldozer or the like.

Other aspects, objects and advantages of the present invention can be obtained from a study of the drawings, the disclosure and the appended claims.

What is claimed is:

1. A fluid control system, comprising:

a double-acting actuator having a first actuating chamber, a second actuating chamber, and an actuating member disposed for movement therebetween;

a first pilot signal operated check valve connected to the first actuating chamber and operable for controlling fluid flow therefrom;

a second pilot signal operated check valve connected to the second actuating chamber and operable for controlling fluid flow therefrom;

a pilot signal operated, three position directional control valve having a first port connected to the first pilot signal operated check valve, a second port connected to the second pilot signal operated check valve, a tank port and a pump port, the directional control valve and the check valves being cooperatively operable under a first pilot signal condition of an initial pressure magnitude to allow fluid flow from the first actuating chamber to the tank port and fluid flow from the pump port to the second actuating chamber, and the directional control valve and the check valves being cooperatively operable under a second pilot signal condition to allow fluid flow between the actuating chambers to allow pressure conditions therein to equalize such that the actuating member is allowed to float; and a valve arrangement connected to the check valves and the directional control valve for producing the first and second pilot signal conditions thereon, the valve arrangement including a pilot signal control valve operable for directing the first pilot signal condition to the second pilot signal condition when the pressure magnitude of the first pilot signal condition exceeds the initial pressure magnitude.

2. The fluid control system of claim 1, wherein the pilot signal control valve is disposed between a pilot actuator and the directional control valve.

3. The fluid control system of claim 2, wherein the pilot signal control valve is operable by a pilot signal from the pilot actuator.

4. The fluid control system of claim 1, wherein the three positions include a first position when the first pilot signal condition is present on the directional control valve, a second position when the second pilot signal condition is present, and a third position when a third pilot signal condition is present to allow fluid flow from the second actuating chamber to the tank port and fluid flow from the pump port to the first actuating chamber.

* * * * *